US011717716B2

(12) United States Patent
Koh

(10) Patent No.: US 11,717,716 B2
(45) Date of Patent: Aug. 8, 2023

(54) MEDICINE BALL AND METHOD OF OPERATING THEREOF

(71) Applicant: Chau Ern Koh, Chicago, IL (US)

(72) Inventor: Chau Ern Koh, Chicago, IL (US)

( * ) Notice: Subject to any disclaimer, the term of this patent is extended or adjusted under 35 U.S.C. 154(b) by 0 days.

(21) Appl. No.: 17/376,402

(22) Filed: Jul. 15, 2021

(65) Prior Publication Data

US 2023/0146190 A1 May 11, 2023

(51) Int. Cl.
*A63B 21/22* (2006.01)
*A63B 21/00* (2006.01)
*A63B 24/00* (2006.01)

(52) U.S. Cl.
CPC ..... *A63B 21/222* (2015.10); *A63B 21/0004* (2013.01); *A63B 21/00069* (2013.01); *A63B 21/00076* (2013.01); *A63B 24/0087* (2013.01); *A63B 2225/74* (2020.08)

(58) Field of Classification Search
CPC ..... A63B 21/222; A63B 21/0004; A63B 21/00069; A63B 21/00076; A63B 24/0087; A63B 2225/74
See application file for complete search history.

(56) References Cited

U.S. PATENT DOCUMENTS 3,726,146 A * 4/1973 Mishler ..... G01C 19/02 446/233
5,150,625 A * 9/1992 Mishler ..... A63B 23/03508 446/233
6,629,908 B2 * 10/2003 Hamady ..... A63B 21/222 482/44
7,326,156 B2 * 2/2008 Dworzan ..... A63B 21/222 482/44
7,645,203 B2 * 1/2010 Tang ..... A63B 41/085 473/610
7,803,092 B2 * 9/2010 Gilliam ..... A63B 24/0003 482/148
7,935,035 B2 * 5/2011 Smith ..... A63B 21/22 482/44
8,061,047 B2 * 11/2011 Igarashi ..... E21B 47/024 33/304
8,456,026 B2 * 6/2013 Cleveland ..... F03G 7/08 290/1 A
8,562,386 B2 * 10/2013 Carlson ..... A63H 29/20 446/431
8,652,012 B2 * 2/2014 Smith ..... A63B 21/222 446/233
9,135,347 B2 * 9/2015 Damman ..... G06Q 10/10
9,155,950 B2 * 10/2015 Fernandez ..... A63B 67/06
9,180,346 B2 * 11/2015 Binette ..... C08L 75/14
9,463,354 B2 * 10/2016 Chuang ..... A63B 21/222
10,331,218 B2 6/2019 Deutsch
(Continued)

*Primary Examiner* — Garrett K Atkinson
(74) *Attorney, Agent, or Firm* — UIC School of Law Patent Clinic

(57) ABSTRACT

A medicine ball has a gyroscope housed inside a rotatable capsule, a user interface configured to receive a user input, a programmable controller, and a power source each communicatively coupled with the user interface. In operation, the power source supplies power to the gyroscope, the rotatable capsule, and the programmable controller in response to receiving the user input at the user interface. The programmable controller controls the movement of the gyroscope and the rotatable capsule in response to receiving the user input at the user interface.

16 Claims, 4 Drawing Sheets

(56) References Cited

U.S. PATENT DOCUMENTS

| | | | | |
|---|---|---|---|---|
| 10,532,832 | B2 * | 1/2020 | Zhang | H02K 16/00 |
| 10,551,189 | B2 * | 2/2020 | McGuinness | G01C 19/02 |
| 2005/0107227 | A1 * | 5/2005 | Massey | A63B 21/0552 482/121 |
| 2005/0143234 | A1 * | 6/2005 | Massey | A63B 21/02 482/121 |
| 2005/0277499 | A1 * | 12/2005 | Tang | A63B 41/085 473/604 |
| 2009/0312159 | A1 * | 12/2009 | Gilliam | A63B 21/0601 482/93 |
| 2013/0109513 | A1 * | 5/2013 | Fernandez | A63B 67/06 473/585 |
| 2014/0155226 | A1 * | 6/2014 | Chuang | A63B 21/0004 482/46 |
| 2015/0111666 | A1 * | 4/2015 | Binette | A63B 37/0063 473/373 |
| 2016/0161255 | A1 * | 6/2016 | McGuinness | A63B 21/222 74/5.37 |
| 2017/0182352 | A1 * | 6/2017 | Kang | A63B 23/14 |
| 2017/0189738 | A1 * | 7/2017 | Oremus | A63B 21/157 |
| 2017/0304685 | A1 * | 10/2017 | Iqbal | A63B 45/00 |
| 2018/0214755 | A1 * | 8/2018 | Villalba | A63B 67/08 |
| 2021/0236870 | A1 * | 8/2021 | Bergengren | A63B 21/0056 |
| 2022/0331645 | A1 * | 10/2022 | Hubble | A63B 21/0004 |

* cited by examiner

MEDICINE BALL AND METHOD OF OPERATING THEREOF

BACKGROUND OF THE INVENTION

Field of the Invention

The present disclosure relates to devices used for physical therapy, and more specifically to medicine balls used in treatment of unstable joints.

Problem to be Solved

For patients with unstable joints, it is common treatment for physical therapists to manually apply randomized forces to the unstable joint. This is done because the treatment challenges the body to stabilize itself against these forces. Applying these random forces simulates a rhythmic stabilization, which is a proprioceptive neuromuscular facilitation technique. This technique improves the motor control and the stabilization of the joint that is being challenged.

Currently, physical therapists must be with the patient to manually apply the randomized forces to the unstable joints. This can be time-consuming for the physical therapist. Accordingly, there is a need for an improved way for a physical therapist to apply this type of treatment. One way is a device that can automatically apply these random forces on a patient's unstable joints, as well as being able to increase the weight of the forces gradually and methodically, as well as the time duration, of the randomized forces acting against an unstable joint, without the physical therapist needing to be physically next to the patient and applying the forces themselves.

Currently, medicine balls are typically used for strength training. This typically requires the user to move the medicine ball themselves. This does not work well for treating unstable joints, as it only requires that the user's body moves in a way where joints are only used in a stable way. Further to this, it does not require the body of the user to stabilize against random forces. Accordingly, there is a need for an improved way to use a medicine ball to help treat unstable joints.

Description of Prior Art

WO 2006115822 (Yewer et al.) publication describes a medicine ball that includes a gyroscope that is powered by a battery, where the gyroscope object can create low impact instability in a pattern that is useful for exercise. However, the '822 publication does not teach or suggest that the gyroscope is housed within a rotatable capsule disposed within the medicine ball, where the gyroscope as well as the rotatable capsule are controlled together to produce random perturbations through the structure of a medicine ball. Further, the '822 publication does not teach or suggest that the invention is to be used in the user's hands, but rather it suggests that the invention be used on the ground. Because the '822 publication does not describe an invention that creates any forces, it is unable to help with the treatment of unstable joints using a rhythmic stabilization with random directional forces.

WO 2018178457 (Vidal et al.) publication describes a medicine ball that includes an electronic measuring means having a gyroscope and a switch that turns the system on and off. Further the '457 publication describes an invention which has the objective of measuring forces. However, the '457 publication does not teach or suggest that the gyroscope is housed within a rotatable capsule disposed within a medicine ball, where the gyroscope as well as the rotatable capsule are controlled together to produce random perturbations through the structure of the medicine ball. Further, the '457 publication does not describe an invention that creates any forces. Because the '457 publication does not describe an invention that creates any forces, it is unable to help with the treatment of unstable joints using a rhythmic stabilization with random directional forces.

U.S. Pat. No. 9,135,347 (Damman et al.) patent describes a medicine ball having a weight and a three-axis gyroscope. Further, the '347 patent describes an invention used to track exercise data. However, the '347 patent does not teach or suggest that the gyroscope is housed within a rotatable capsule disposed within the medicine ball, where the gyroscope as well as the rotatable capsule are controlled together to produce random perturbations through the structure of a medicine ball. Because the '347 patent does not describe an invention that creates any forces, it is unable to help with the treatment of unstable joints using a rhythmic stabilization with random directional forces.

Statement of the Objects of the Invention

The first objective of the invention is to generate randomized forces inside of a medicine ball. The second objective is to use the medicine ball as part of the treatment for unstable joints by requiring the body to stabilize the unstable joints by counteracting against these randomized forces. The third objective of the invention is to allow this type of treatment to be done without a physical therapist manually creating these forces.

SUMMARY OF THE INVENTION

A medicine ball has a gyroscope housed inside a rotatable capsule, a user interface configured to receive a user input, a programmable controller, and a power source each communicatively coupled with the user interface. In operation, the power source supplies power to the gyroscope, the rotatable capsule, and the programmable controller in response to receiving the user input at the user interface. The programmable controller controls the movement of the gyroscope and the rotatable capsule in response to receiving the user input at the user interface.

A BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
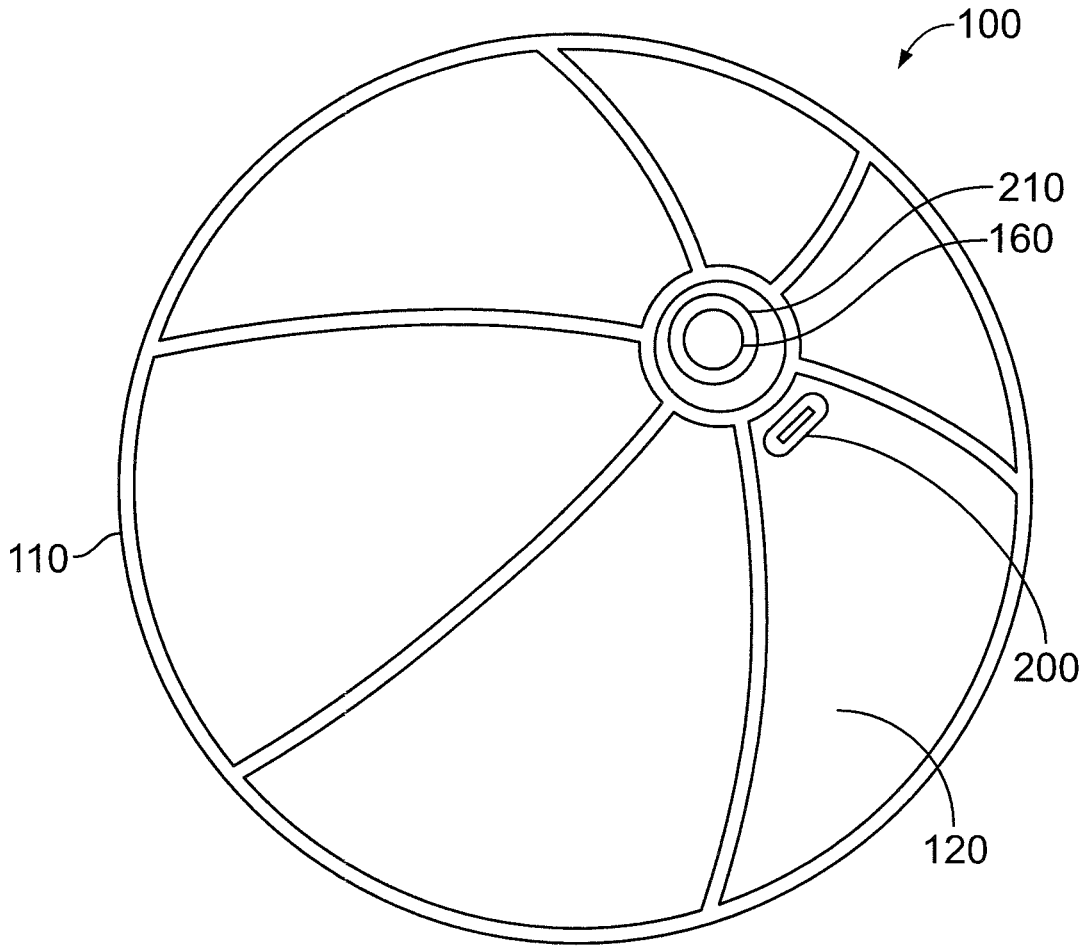
FIG. 1 is a perspective view of a medicine ball in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE ILLUSTRATED EMBODIMENTS

One embodiment provides a medicine ball comprising a gyroscope housed inside a rotatable capsule, a user interface configured to receive a user input, a programmable controller communicatively coupled with the user interface, and a power source communicatively coupled with the user interface. The programmable controller controls the movement of the gyroscope and the rotatable capsule in response to receiving the user input at the user interface. The power source supplies power to the gyroscope, the rotatable capsule, and the programmable controller in response to receiving the user input at the user interface.

Another embodiment provides a medicine ball comprising a rotatable capsule, a gyroscope disposed within the rotatable capsule, an outer spherical body housing the rotatable capsule and the gyroscope, a user interface disposed on an exterior surface of the outer spherical body, a programmable controller disposed within an interior surface of the outer spherical body, and a battery disposed within the interior surface of the outer spherical body. The programmable controller is electrically connected to the user interface. The programmable controller controls a duration of activation of the gyroscope and of the rotatable capsule as a function of user input received at the user interface. Further the battery is electrically connected to the programmable controller, the gyroscope, and the rotatable capsule and the battery is operatively controlled by the programmable controller to supply power to activate the gyroscope and the rotatable capsule in response to the user input received at the user interface. The rotatable capsule upon activation rotates randomly on multiple axes relative to the outer spherical body, and the gyroscope upon activation rotates on at least one axis relative to the outer spherical body. The rotation of the rotatable capsule and of the gyroscope creates randomized forces directed toward the outer spherical body of the medicine ball.

A further embodiment provides a method of operating a medicine ball including a gyroscope disposed within a rotatable capsule. The method comprises: receiving, at a user interface, a user input; supplying, in response to receiving the user input, power for activating the gyroscope and the rotatable capsule, the rotatable capsule upon activation rotating randomly on multiple axes and the gyroscope upon activation rotating on at least one axis, the rotation of the rotatable capsule and of the gyroscope creating randomized forces directed toward an outer surface of the medicine ball; and controlling, via a programmable controller, a duration of activation of the gyroscope and of the rotatable capsule as a function of the user input.

Each of the above-mentioned embodiments will be discussed in more detail below, starting with example structure of a medicine ball in which the embodiments may be practiced, followed by an illustration of processing blocks for achieving an improved operation of the medicine ball. Example embodiments are herein described with reference to flowchart illustrations of methods according to example embodiments. It will be understood that each block of the flowchart illustrations and/or block diagrams, and combinations of blocks in the flowchart illustrations and/or block diagrams, can be implemented by a programmable controller. The methods and processes set forth herein need not, in some embodiments, be performed in the exact sequence as shown and likewise various blocks may be performed in parallel rather than in sequence. Accordingly, the elements of methods and processes are referred to herein as "blocks" rather than "steps."

Further advantages and features consistent with this disclosure will be set forth in the following detailed description, with reference to the figures.

Figure 2:
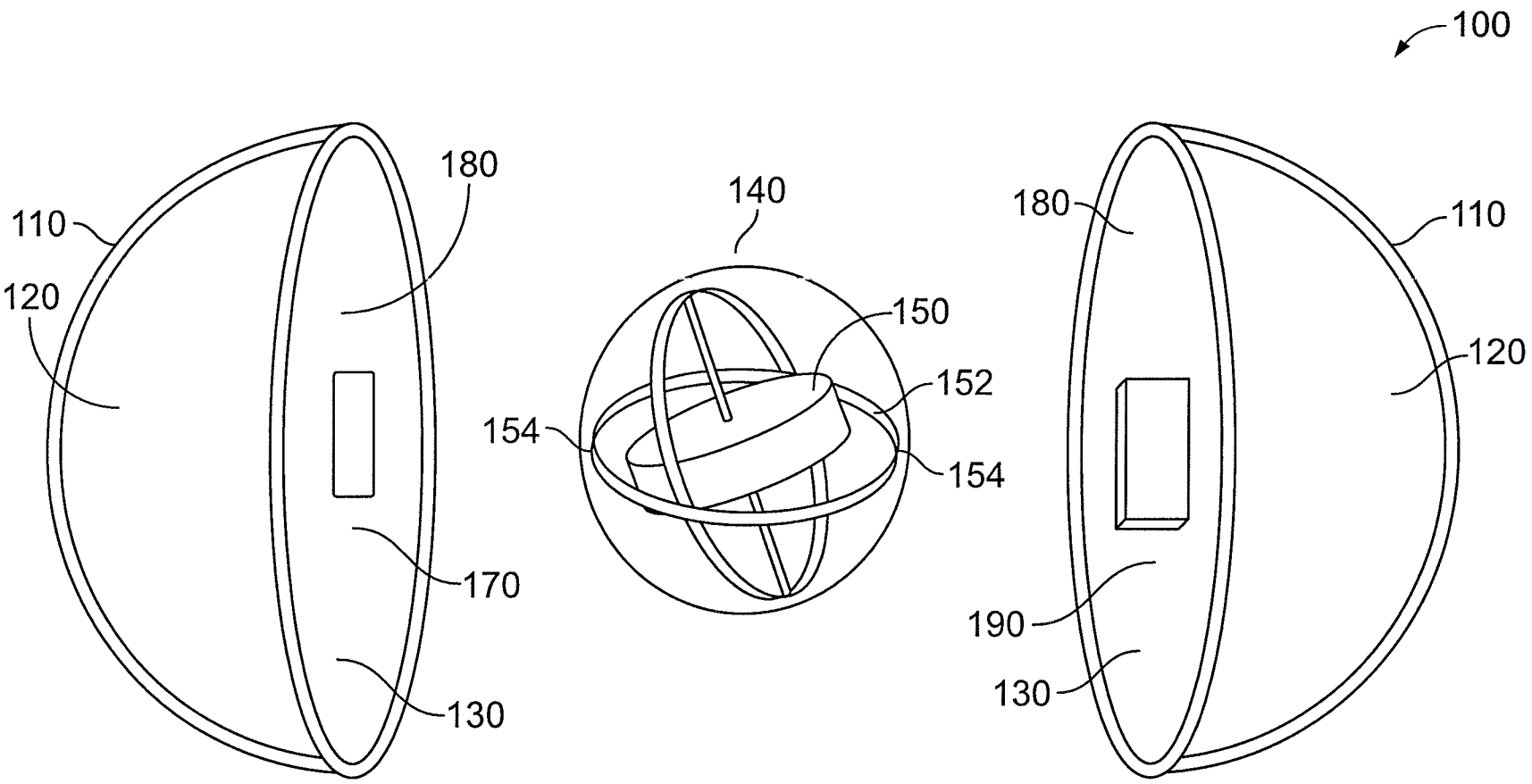
FIG. 2 is a broken view of a medicine ball in accordance with some embodiments.

Referring now to the drawings, and in particular FIGS. 1 and 2, a perspective view of a medicine ball 100 and an exploded view of the medicine ball 100 are respectively shown. The medicine ball 100 includes an outer body 110 (referred herein as outer spherical body 110) that may be substantially spherical in shape as shown in FIG. 1. In alternative embodiments, the outer body 110 may take form of a football shaped body or an elongated body designed to be gripped with a hand during its operation by a user. In accordance with some embodiments, an exterior surface 120 of the medicine ball 100 is gently textured to improve grip. The outer spherical body 110 may be made of an elastic material such as a rubber. In other embodiments, the medicine ball 100 may be made of any durable material (e.g., plastic) that has enough friction to be gripped well. The medicine ball 100 may be designed in different sizes and weights. As an example, the medicine ball 100 may be designed to weigh two (2) pounds with three (3) inches diametrical length to allow a user to grip the medicine ball 100 with one hand during the operation of the medicine ball 100. As another example, the medicine ball 100 may be designed to weigh eight (8) pounds with nine (9) inches diametrical length to allow the user to grip the medicine ball 100 with two hands during the operation of the medicine ball 100. Other possibilities exist as well.

The outer spherical body 110 of the medicine ball 100 has an interior cavity 130 (FIG. 2) adapted to hold a rotatable capsule 140 and a gyroscope 150 that are disposed within the rotatable capsule 140. The outer ring 152 of the gyroscope 150 is pivotally attached to the interior of the rotatable capsule 140 as shown at 154 of FIG. 2. The medicine ball 100 further includes a user interface 160 (FIG. 1) disposed on the exterior surface 120 of the outer spherical body 110, a programmable controller 170 (FIG. 2) disposed within an interior surface 180 of the outer spherical body 110, and a power source, such as a battery 190 (e.g., a lithium-ion battery, a nickel-cadmium battery, a nickel-metal hydride battery, or an external AA/AAA battery) disposed within the interior surface 180 of the outer spherical body 110. The user interface 160 is configured to receive user input from a user. The programmable controller 170 is electrically and communicatively connected to the user interface 160 to enable the programmable controller 170 to receive user input received at the user interface 160. The battery 190 is electrically connected to power the programmable controller 170, the gyroscope 150, and the rotatable capsule 140.

In one embodiment, the user interface 160 may take form of a push button which may be pressed or activated to switch the operation of the medicine ball 100 from standby mode to active mode. In one embodiment, the medicine ball 100 may be designed without any user interface. In this embodiment, the medicine ball 100 may be programmed to switch its operation from standby mode to active mode in response to receiving an external force (e.g., upon shaking the medicine ball or by subjecting the medicine ball 100 to an external force) applied to the medicine ball 100.

When the medicine ball 100 is operated in standby mode, the programmable controller 170 disengages the electrical connection between the gyroscope 150 and the rotatable capsule 140, such that, the gyroscope 150 and the rotatable capsule 140 no longer rotate. On the other hand, when the medicine ball 100 is switched to operate in active mode, the programmable controller 170 directs power from the battery 190 to activate the gyroscope 150 to spin at preset revolutions per minute (RPM). The programmable controller 170 also directs power to an electrical motor (not shown) which randomly rotates the rotatable capsule 140 within which the gyroscope 150 is encapsulated. In other words, the programmable controller 170 operatively controls the battery 190 to supply power to activate the gyroscope 150 and the rotatable capsule 140 in response to user input received at the user interface 160. Further the rotatable capsule 140 upon activation rotates randomly on multiple axes relative to the outer spherical body 110 and the gyroscope 150 upon activation rotates on at least one axis relative to the outer spherical body 110. In one embodiment, the gyroscope 150 may be a multi-axial gyroscope that can rotate on multiple axes relative to the outer spherical body 110, and the rotatable capsule 140 may be configured to rotate on a single axis relative to the outer spherical body 110. Alternatively, the gyroscope 150 may be a single-axial gyroscope that can rotate only on single axis relative to the outer spherical body 110.

In accordance with the illustrated embodiments, the rotation of the rotatable capsule 140 and the rotation of the gyroscope 150 create randomized forces or perturbations directed toward the outer spherical body 110. As an example, the gyroscope 150 and the rotatable capsule 140 upon their rotation may provide randomized forces of 0.5-1 lbs. for a programmed amount of time for the '3' inch medicine ball 100. As another example, the gyroscope 150 and the rotatable capsule 140 upon their rotation may provide randomized forces of 2-4 lbs. for a programmed amount of time for the '9' inch medicine ball 100.

The programmable controller 170 may comprise an electronic processor (for example, a microprocessor, a logic circuit, an application-specific integrated circuit, a field-programmable gate array, or another electronic device), volatile memory, nonvolatile memory such as EEPROM for storing programming, and nonvolatile storage, e.g., flash memory, for storing firmware and operational parameters. The memory of programmable controller 170 may store program instructions that, when executed by the electronic processor of the programmable controller, cause the electronic processor to perform the operations described with reference to FIGS. 3 and 4. In accordance with the illustrated embodiments, the programmable controller 170 is configured to control a duration of activation of the gyroscope 150 and of the rotatable capsule 140 as a function of user input received at the user interface 160. In one embodiment, the programmable controller 170 controls a duration of activation of the gyroscope 150 based on a number of times user input is received (e.g., push button is pressed) at the user interface 160 in a given time (e.g., 10 seconds). In another embodiment, the programmable controller 170 controls a duration of activation of the gyroscope 150 based on whether a subsequent user input is received within a predefined time period (e.g., 3 seconds) from the preceding user input. For example, when a push button of the user interface 160 is pressed for a second time within a predefined time period from a first time of the button being pressed, then the programmable controller 170 may activate the gyroscope 150 and rotatable capsule 140 for a longer time (e.g., 30 seconds activation time) in comparison to the push button pressed only once (e.g., 15 seconds activation time).

The programmable controller 170 may send commands responsive to user input(s) received at the user interface 160 to switch the operation of the medicine ball 100 from a standby mode to an active mode or alternatively from active mode to standby mode. For example, when the programmable controller 170 detects that a push button of the user interface 160 is pressed once within a given time (e.g., 10 seconds), the programmable controller 170 controls the medicine ball 100 to operate in active mode for an activation time of 15 seconds. When the push button of the user interface 160 is pressed two times within the given time (or when the push button is pressed a second time within a predefined time period from a first time of pressing the push button), the medicine ball 100 is operated in active mode for 30 seconds. When the push button of the user interface 160 is pressed three times, the medicine ball 100 is operated in active mode for 60 seconds. When the push button of the user interface 160 is pressed four times, the medicine ball 100 is operated in active mode for an indefinite time duration unless the push button is pressed again to switch the operation of the medicine ball 100 from active mode to standby mode or the battery 190 is discharged. In other words, at any time the medicine ball 100 is operating in active mode, the push button of the user interface 160 can be pressed again to switch its operation from an active mode to a standby mode. In standby mode, the rotatable capsule 140 and the gyroscope 150 stop their rotation which results in the medicine ball 100 no longer producing any randomized forces. In other words, the programmable controller 170 is configured to deactivate the gyroscope 150 and the rotatable capsule 140 when another user input is received at the user interface 160 upon activation of the gyroscope 150 and of the rotatable capsule 140.

In accordance with some embodiments, the programmable controller 170 is further programmed to control a speed of rotation of the gyroscope 150 and of the rotatable capsule 140 as a function of user input received at user interface 160. For example, in these embodiments, the programmable controller 170 operatively controls the battery 190 to adjust the amount of power supplied to a driving mechanism such as a motor that causes the gyroscope 150 and/or the rotatable capsule 140 to rotate upon activation. In these embodiments, the speed of rotation of the gyroscope 150 and the rotatable capsule 140 may be varied as a function of the power supplied by the battery 190 during the activation of the gyroscope 150 and of the rotatable capsule 140.

As shown in FIG. 1, the medicine ball 100 further includes a charging port 200 and a light emitting component 210 that are disposed on the exterior surface 120 of the outer spherical body 110. The charging port 200 (e.g., USB-C port) is adapted to be electrically coupled to an external power source to charge the battery 190. The light emitting component 210 is controlled by the programmable controller 170 to emit light indicating a duration of activation of the gyroscope 150 and of the rotatable capsule 140 based on user input received at the user interface 160. In one embodiment, the light emitting component 210 includes a light emitting diode (LED) ring that is disposed around the user interface 160 such as a push button to indicate a duration of activation of the gyroscope 150 and activation of the rotatable capsule 140. In this embodiment, the LED ring emits lights in different colors or patterns to indicate a specified time duration that the medicine ball 100 will operate in active mode. For example, when the push button of the user interface 160 is pressed once, the LED ring may emit yellow light to indicate an activation time of 15 seconds. When the push button of the user interface 160 is pressed two times, the LED light turns red indicating an activation time of 30 seconds. When the push button of the user interface 160 is pressed three times, the LED light turns blue indicating an activation time of 60 seconds. When the push button of the user interface 160 is pressed four times, the LED light turns green indicating an indefinite activation time. The green LED light may also indicate to a user operating the medicine ball 100 that the medicine ball 100 will remain in active mode until the push button of the user interface 160 is pressed again by the user.

Figure 3:
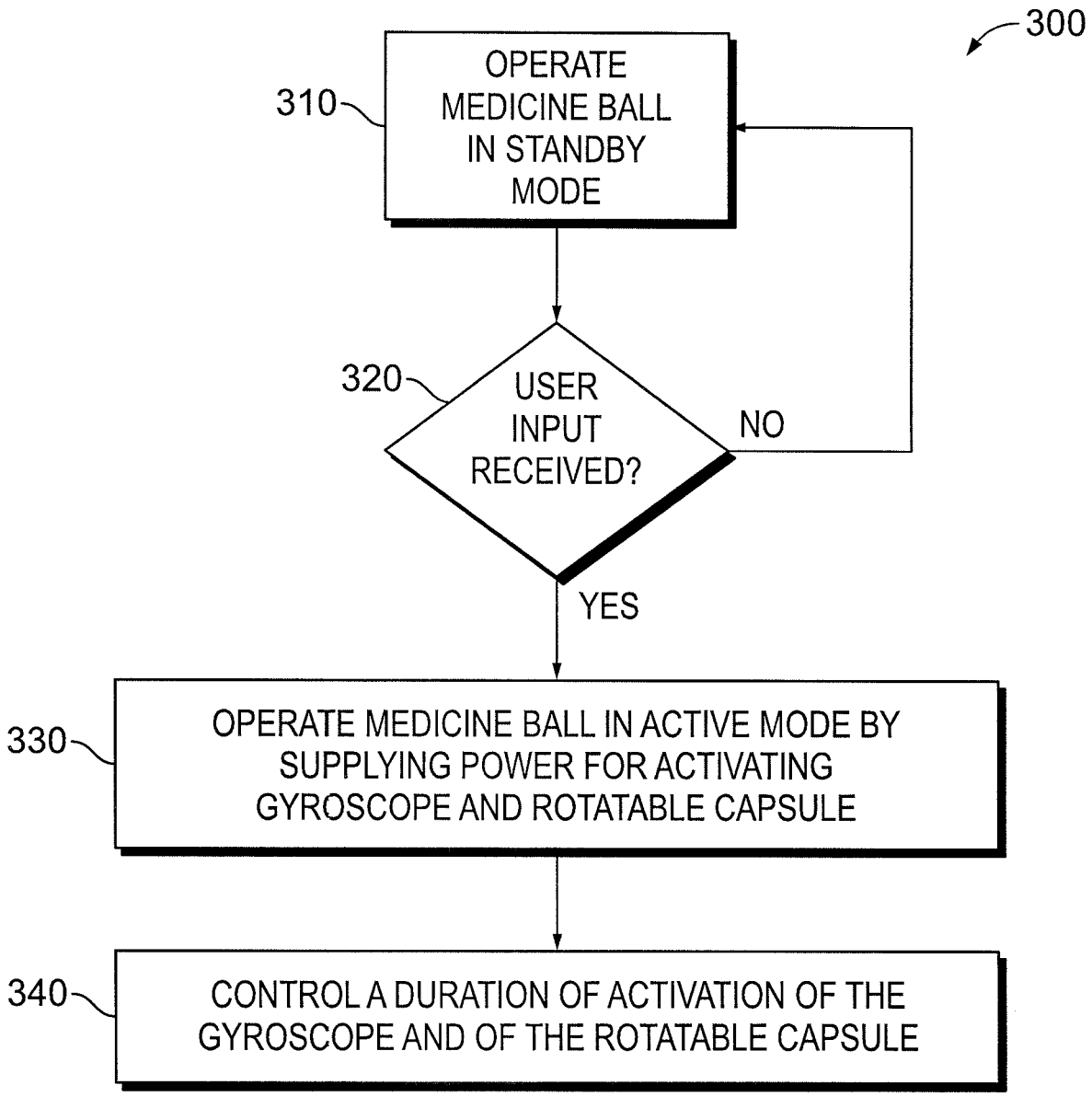
FIG. 3 is a flow diagram of a method of operating the medicine ball shown in FIGS. 1 and 2 in accordance with some embodiments.

Turning now to FIG. 3, a flowchart diagram illustrates a method 300 of operating the medicine ball 100 shown in FIGS. 1 and 2 in accordance with some embodiments. While a particular order of processing steps is indicated in FIG. 3 as an example, timing and ordering of such steps may vary where appropriate without negating the purpose and advantages of the examples set forth in detail throughout the remainder of this disclosure. A programmable controller 170 shown in FIG. 2 may execute the method 300 of operating the medicine ball 100.

At block 310, the medicine ball 100 operates in standby mode. During standby mode, the programmable controller 170 disengages the battery 190 and the gyroscope 150 and rotatable capsule 140, such that, power is no longer supplied to the gyroscope 150 and the rotatable capsule 140. In other words, the gyroscope 150 and the rotatable capsule 140 are not activated during the standby mode and therefore the gyroscope 150 and the rotatable capsule 140 do not rotate when the medicine ball 100 is operated in standby mode.

At block 320, the programmable controller 170 determines whether a user input has been received at the user interface 160. In one embodiment, the programmable controller 170 receives a user input when a push button of the user interface 160 is pressed or pushed by the user. If no user input is received, the programmable controller 170 continues to monitor for any user input received at the user interface 160 at block 320. Otherwise, when user input is received at the user interface 160, at block 330, the programmable controller 170 switches the operation of the medicine ball 100 from the standby mode to an active mode. In active mode, the programmable controller 170 activates the electrical connection between the battery 190 and the gyroscope 150 and the rotatable capsule 140. The electrical connection causes the battery 190 to supply power to activate the gyroscope 150 and the rotatable capsule 140. The rotatable capsule 140 upon activation rotates randomly on multiple axes relative to the outer spherical body 110 and the gyroscope 150 upon activation rotates on at least one axis relative to the outer spherical body 110. The rotation of the rotatable capsule 140 and the rotation of the gyroscope 150 create randomized forces directed toward the outer spherical body 110. The randomized forces so created can be used in treatment of joint instability.

At block 340, the programmable controller 170 further controls a duration of activation of the gyroscope 150 and of the rotatable capsule 140 in response to receiving the user input received at the user interface 160. For example, when the programmable controller 170 determines that a push button of the user interface 160 is pressed once within a given time (e.g., '10' seconds), the programmable controller 170 controls the medicine ball 100 to operate in active mode (i.e., by engaging the electrical connection between the battery 190 and the gyroscope 150 and the rotatable capsule 140) for an activation time of '15' seconds. When the push button of the user interface 160 is pressed two times within the given time, the medicine ball 100 is operated in active mode for '30' seconds. When the push button of the user interface 160 is pressed three times, the medicine ball 100 is operated in active mode for '60' seconds. When the push button of the user interface 160 is pressed four times, the medicine ball 100 is operated in active mode for an indefinite time duration unless the push button is pressed again to switch the operation of the medicine ball 100 from active mode to standby mode or the battery 190 is discharged. In other words, at any time the medicine ball 100 is operating in active mode, the push button of the user interface 160 can be pressed again to switch its operation from active mode to standby mode.

Figure 4:
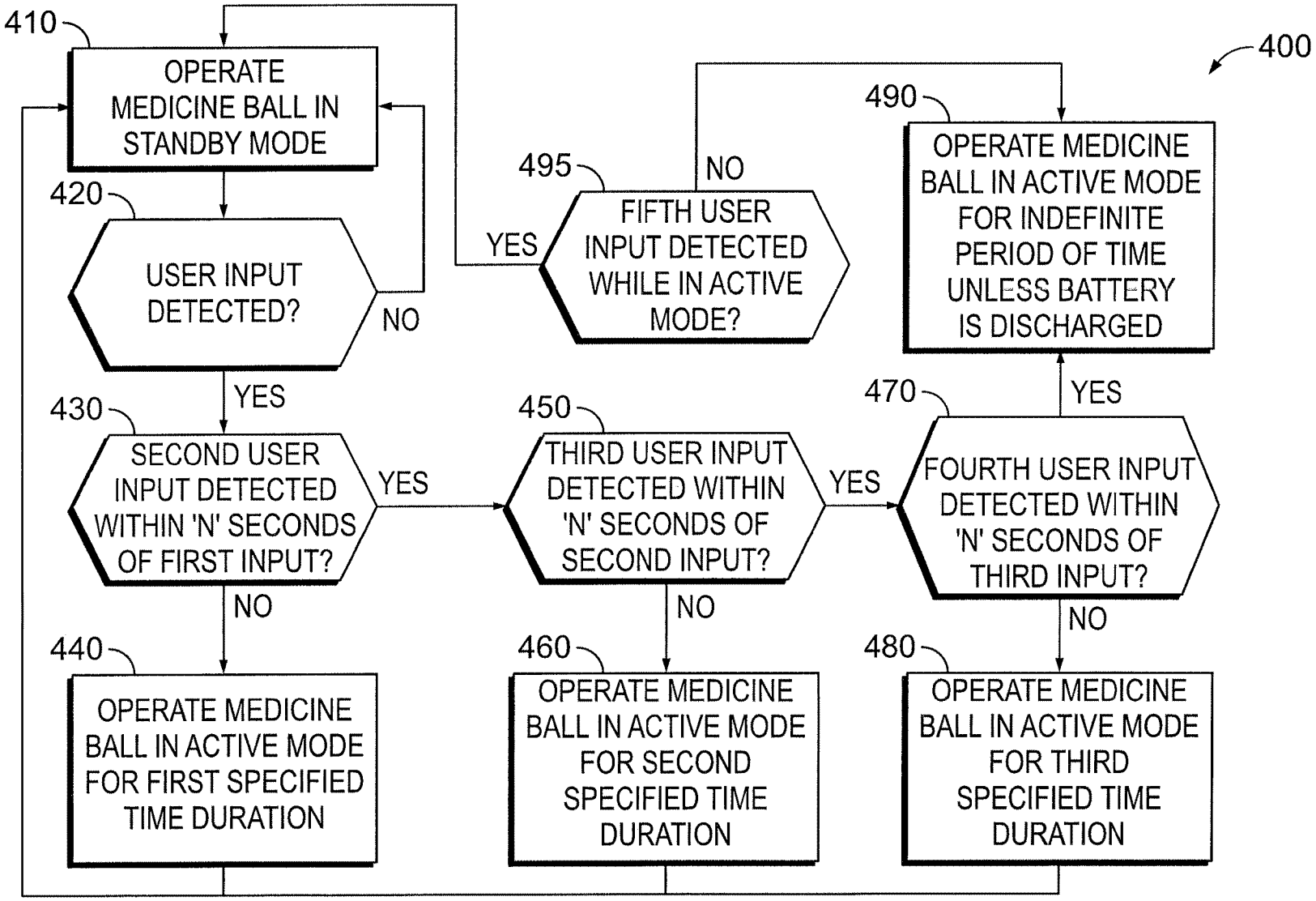
FIG. 4 is a flow diagram of another method of operating the medicine ball shown in FIGS. 1 and 2 in accordance with some embodiments.

Turning now to FIG. 4, a flowchart diagram illustrates another method 400 of operating the medicine ball 100 shown in FIGS. 1 and 2 in accordance with some embodiments. While a particular order of processing steps is indicated in FIG. 4 as an example, timing and ordering of such steps may vary where appropriate without negating the purpose and advantages of the examples set forth in detail throughout the remainder of this disclosure. A programmable controller 170 shown in FIG. 2 may execute the method 400 of operating the medicine ball 100.

At block 410, the medicine ball 100 operates in standby mode. During standby mode, the programmable controller 170 disengages the battery 190 and the gyroscope 150 and rotatable capsule 140, such that, power is no longer supplied to the gyroscope 150 and the rotatable capsule 140. In other words, the gyroscope 150 and the rotatable capsule 140 are not activated during the standby mode and therefore the gyroscope 150 and the rotatable capsule 140 do not rotate when the medicine ball 100 is operated in standby mode.

At block 420, the programmable controller 170 detects whether a user input has been received at the user interface 160. In one example, the programmable controller 170 receives the user input when a push button of the user interface 160 is pressed or pushed by the user. If no user input is received, the programmable controller 170 continues to monitor at block 420 for any user input received at the user interface 160. Otherwise, when a user input is received at the user interface 160 within a given time 'N', the programmable controller 170 detects if a second user input is received at the user interface 160. As an example, the given time 'N' can be '3' seconds from the first input, or alternatively can be '10' seconds within which a second input (i.e., push button being pressed two times) should be received after the first input.

If a second user input is not received at the user interface 160 within the given time 'N', the programmable controller 170, at block 440, controls the medicine ball 100 to be operated in active mode for a first specified time duration (e.g., 15 seconds). To switch the operation of the medicine ball 100 from standby mode to active mode, the programmable controller 170 engages electrical connection between the battery 190 and the light emitting component 210, as well as an electrical connection between the battery 190 and the gyroscope 150 and the rotatable capsule 140. The electrical connection causes the battery 190 to supply power to the light emitting component 210 and the programmable controller 170 causes the light emitting component 210 to emit a colored light (e.g., yellow). The electrical connection further causes the battery 190 to supply power to activate the gyroscope 150 and the rotatable capsule 140. The rotatable capsule 140 upon its activation rotates randomly on multiple axes relative to the outer spherical body 110 to produce randomized forces for a first specified time duration. The gyroscope 150 upon its activation rotates randomly on single axis (or in another embodiment, multiple axes) relative to the outer spherical body 110 to produce randomized forces for a first specified time duration. After the first specified time duration, the medicine ball 100 returns to standby mode at block 410, whereby, the programmable controller 170 disengages the electrical connection between the gyroscope 150 and the rotatable capsule 140, such that the gyroscope 150 and the rotatable capsule 140 no longer rotate. Otherwise, when a second user input is received at the user interface 160 within the given time 'N', at block 430, the programmable controller 170, at block 450, waits a given time to detect if a third user input is received at the user interface 160. As an example, the given time 'N' can be '3' seconds from the second input, or alternatively three inputs (i.e., push button being pressed three times) within '10' seconds.

If a third user input is not received at the user interface 160 within the specified time duration, the programmable controller 170, at block 460, controls the medicine ball 100 to be operated in active mode for a second specified time duration (e.g., 30 seconds). To switch the operation of the medicine ball 100 from standby mode to active mode, the programmable controller 170 engages the electrical connection between the battery 190 and the light emitting component 210, as well as between the battery 190 and the gyroscope 150 and the rotatable capsule 140. The electrical connection causes the battery 190 to supply power to the light emitting component 210 and the programmable controller 170 causes the light emitting component 210 to emit a colored light (e.g., red). The electrical connection further causes the battery 190 to supply power to activate the gyroscope 150 and the rotatable capsule 140. The rotatable capsule 140 upon its activation rotates randomly on multiple axes relative to the outer spherical body 110 to produce randomized forces for a second specified time duration. The gyroscope 150 upon its activation rotates randomly on single axis (or in another embodiment multiple axes) relative to the outer spherical body 110 to produce randomized forces for a second specified time duration. After the second specified time duration, the medicine ball 100 returns to standby mode at block 410, whereby the programmable controller 170 disengages the electrical connection between the gyroscope 150 and the rotatable capsule 140, such that the gyroscope 150 and the rotatable capsule 140 no longer rotate. Otherwise, when a third user input is received at the user interface 160 within the given time 'N', the programmable controller 170, at block 470, waits a given time to detect if a fourth user input is received at the user interface 160. As an example, the given time 'N' can be '3' seconds from the third input, or alternatively four inputs (i.e., push button being pressed four times) within '10' seconds.

If a fourth user input is not received at the user interface 160 within the given time, the programmable controller 170, at block 480, controls the medicine ball 100 to be operated in active mode for a third specified time duration (e.g., 60 seconds). To switch the operation of the medicine ball 100 from standby mode to active mode, the programmable controller 170 engages the electrical connection between the battery 190 and the light emitting component 210, as well as an electrical connection between the battery 190 and the gyroscope 150 and the rotatable capsule 140. The electrical connection causes the battery 190 to supply power to the light emitting component 210 and the programmable controller 170 causes the light emitting component 210 to emit a colored light (e.g., blue). The electrical connection further causes the battery 190 to supply power to activate the gyroscope 150 and the rotatable capsule 140. The rotatable capsule 140 upon its activation rotates randomly on multiple axes relative to the outer spherical body 110 to produce randomized forces for a third specified time duration. The gyroscope 150 upon its activation rotates randomly on a single axis (or in another embodiment multiple axes) relative to the outer spherical body 110 to produce randomized forces for a third specified time duration. After the third specified time duration, the medicine ball 100 returns to standby mode at block 410, whereby, the programmable controller 170 disengages the electrical connection between the gyroscope 150 and the rotatable capsule 140, such that, the gyroscope 150 and the rotatable capsule 140 no longer rotate.

Otherwise, when a fourth user input is received at the user interface 160 within the given time 'N', at block 470, the programmable controller, at block 490, controls the medicine ball 100 to be operated in active mode for an indefinite time duration. To switch the operation of the medicine ball 100 from standby mode to active mode, the programmable controller 170 engages the electrical connection between the battery 190 and the light emitting component, as well as between the battery 190 and the gyroscope 150 and the rotatable capsule 140. The electrical connection causes the battery 190 to supply power to the light emitting component 210 and the programmable controller 170 causes the light emitting component 210 to emit a colored light (e.g., green). The electrical connection further causes the battery 190 to supply power to activate the gyroscope 150 and the rotatable capsule 140. The rotatable capsule 140 upon its activation rotates randomly on multiple axes relative to the outer spherical body 110 to produce randomized forces for an indefinite time duration. The gyroscope 150 upon its activation rotates randomly on a single axis (or in another embodiment multiple axes) relative to the outer spherical body 110 to produce randomized forces for an indefinite time duration.

The gyroscope 150 and rotatable capsule 140 continue to operate in active mode until either a fifth user input is received at the user interface 160, at block 495, or the battery 190 becomes discharged. As an example, the given time 'N' can be '3' seconds from the fourth input, or alternatively five inputs (i.e., push button being pressed five times) within '10' seconds. Once either a fifth user input is received at the user interface 160 or the battery 190 becomes discharged, the medicine ball 100 returns to standby mode at block 410, whereby, the programmable controller 170 disengages the electrical connection between the gyroscope 150 and the rotatable capsule 140, such that, the gyroscope 150 and the rotatable capsule 140 no longer rotate.

Embodiments of the medicine ball 100 described herein have application in physical therapy and treatment. In physical therapy, it is useful to have such randomized perturbations created during the operation of a medicine ball 100 in active mode applied to body parts in order to treat joint instability. The gyroscope 150 produces external forces in the medicine ball 100 so it creates a shaking sensation when the medicine ball 100 is held in the hand. The shaking sensation creates forces in which the body must react to in order to stabilize itself. This creates a health benefit by challenging parts of the body that are lacking in strength, endurance, and motor control. The randomized forces produced by operating the medicine ball 100 in active mode simulate rhythmic stabilization which is a proprioceptive neuromuscular facilitation technique used to improve motor control and stabilization of whichever body is being challenged. The application of randomized forces that are automatically generated during the operation of the medicine ball 100 in active mode provides significant advantages in contrast to existing practice where it is done manually by another person such as a physical therapist or athletic trainer which can be time consuming. In addition, the medicine ball 100 may be designed in different sizes to allow application to different body parts. Smaller balls (e.g., '3' inch medicine balls) can be held in one hand to challenge the wrist, elbow, and shoulder. Larger balls (e.g., '9' inch medicine balls) can be held with both hands and these balls provide enough force to challenge the core, back, hips, knees, and ankles. Also, the programmable timing (e.g., '15', '30', '45' seconds etc.,) for operating the medicine ball 100 in active mode is useful in a therapeutic setting to match the strength and endurance levels of each user.

The foregoing description of the illustrated embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A medicine ball, comprising:

a rotatable capsule;

a gyroscope disposed within the rotatable capsule;

an outer spherical body housing the rotatable capsule and the gyroscope;

a user interface disposed on an exterior surface of the outer spherical body;

a programmable controller disposed within an interior surface of the outer spherical body, the programmable controller electrically connected to the user interface, the programmable controller controlling a duration of activation of the gyroscope and of the rotatable capsule as a function of user input received at the user interface;

a battery disposed within the interior surface of the outer spherical body, the battery electrically connected to the programmable controller, the gyroscope, and the rotatable capsule, the battery operatively controlled by the programmable controller to supply power to activate the gyroscope and the rotatable capsule in response to the user input received at the user interface; and the rotatable capsule upon activation rotates randomly on multiple axes relative to the outer spherical body, and the gyroscope upon activation rotates on at least one axis relative to the outer spherical body, the rotation of the rotatable capsule and of the gyroscope creating randomized forces directed toward the outer spherical body.

2. The medicine ball of claim 1, wherein the programmable controller is programmed to control a speed of rotation of the gyroscope and of the rotatable capsule as a function of user input received at the user interface.

3. The medicine ball of claim 1, further comprising:

a light emitting component disposed on the exterior surface of the outer spherical body, the light emitting component configured to emit light indicating a duration of activation of the gyroscope and of the rotatable capsule based on user input received at the user interface.

4. The medicine ball of claim 1, further comprising:

a charging port disposed on the exterior surface of the outer spherical body, the charging port adapted to be electrically coupled to an external power source to charge the battery.

5. The medicine ball of claim 1, wherein the programmable controller is configured to deactivate the gyroscope and the rotatable capsule when another user input is received at the user interface upon activation of the gyroscope and of the rotatable capsule.

6. The medicine ball of claim 1, wherein the programmable controller is configured to control the duration of activation of the gyroscope and of the rotatable capsule as a function of the number of times the user input is received at the user interface in a given time.

7. The medicine ball of claim 6, wherein the gyroscope and the rotatable capsule remain activated for a first specified time duration when the number of times the user input is received at the user interface in the given time is one.

8. The medicine ball of claim 7, wherein the gyroscope and the rotatable capsule remain activated for a second specified time duration when the number of times the user input is received at the user interface in the given time is two.

9. The medicine ball of claim 8, wherein the gyroscope and the rotatable capsule remain activated for a third specified time duration when the number of times the user input is received at the user interface in the given time is three.

10. The medicine ball of claim 6, wherein the gyroscope and the rotatable capsule remain activated for an indefinite time duration unless another user input is received at the user interface upon activation of the gyroscope and the rotatable capsule when the number of times the user input is received at the user interface in the given time is four.

11. A method of operating a medicine ball including a gyroscope disposed within a rotatable capsule, the method comprising:

receiving, at a user interface, a user input;

supplying, in response to receiving the user input, power for activating the gyroscope and the rotatable capsule, the rotatable capsule upon activation rotating randomly on multiple axes and the gyroscope upon activation rotating on at least one axis, the rotation of the rotatable capsule and of the gyroscope creating randomized forces directed toward an outer surface of the medicine ball; and controlling, via a programmable controller, a duration of activation of the gyroscope and of the rotatable capsule as a function of the user input.

12. The method of claim 11, further comprising:

controlling, via the programmable controller, a speed of rotation of the gyroscope and of the rotatable capsule as a function of the user input received at the user interface.

13. The method of claim 11, further comprising:

controlling a light emitting component disposed on an outer spherical body of the medicine ball to emit light indicating a duration of activation of the gyroscope and of the rotatable capsule based on the user input received at the user interface.

14. The method of claim 11, further comprising:

deactivating, via the programmable controller, the gyroscope and the rotatable capsule when another user input is received at the user interface during activation of the gyroscope and of the rotatable capsule.

15. The method of claim 11, wherein controlling comprises:

controlling, via the programmable controller, the duration of activation of the gyroscope and of the rotatable capsule as a function of number of times user input is received at the user interface in a given time.

16. The method of claim 15, further comprising:

controlling, via the programmable controller, the gyroscope and the rotatable capsule to remain activated for at least one of:

a first specified time duration when the number of times the user input is received at the user interface in the given time is one;

a second specified time duration when the number of times the user input is received at the user interface in the given time is two;

a third specified time duration when the number of times the user input is received at the user interface in the given time is three; and an indefinite time duration unless another user input is received at the user interface upon activation of the gyroscope and the rotatable capsule when the number of times the user input is received at the user interface in the given time is four, until a fifth user input is received at the user interface.

* * * * *